United States Patent [19]

Matsuura et al.

[11] Patent Number: 4,903,651

[45] Date of Patent: Feb. 27, 1990

[54] ROCKER ARM CLEARANCE REMOVING DEVICE

[75] Inventors: Masaaki Matsuura, Tokyo; Yoichi Ishida, Asaka; Kentaro Kato, Niiza; Takashi Kanbe, Urawa, all of Japan

[73] Assignee: Honda Giken Kogyo Kabushiki Kaisha, Tokyo, Japan

[21] Appl. No.: 263,457

[22] Filed: Oct. 27, 1988

[30] Foreign Application Priority Data

Oct. 29, 1987 [JP] Japan ..... 62-165935[U]
Oct. 29, 1987 [JP] Japan ..... 62-165936[U]

[51] Int. Cl.[4] ..... F01L 1/18; F01L 1/24
[52] U.S. Cl. ..... 123/90.46
[58] Field of Search ..... 123/90.39, 90.43, 90.45, 123/90.46, 90.47

[56] References Cited

U.S. PATENT DOCUMENTS

| | | | |
|---|---|---|---|
| 2,109,809 | 3/1938 | Ranst | 123/90.46 |
| 4,506,635 | 3/1985 | Rinsum | 123/90.46 |
| 4,534,324 | 8/1985 | Deutschmann et al. | 123/90.46 |

*Primary Examiner*—Charles J. Myhre
*Assistant Examiner*—Weilun Lo
*Attorney, Agent, or Firm*—Armstrong, Nikaido, Marmelstein, Kubovcik & Murray

[57] ABSTRACT

Rocker arm clearance removing device wherein a hydraulic adjuster applies torque to a pressure bearing surface at right angles thereto on a curved outwardly extending pressure bearing arm of an eccentric cam which eccentrically supports the rocker arm. Rotation of the rocker arm resulting from the torque causes the rocker arm to come into pressure contact with a valve operating cam and an intake or exhaust valve. An engaging piece can be provided radially extending from the eccentric cam circumferentially spaced from the pressure bearing arm for engaging a swivel stop on the case of the hydraulic adjuster to limit swinging of the eccentric cam and rocker arm during assembly. An arm stopper can also be provided on the case of the hydraulic adjuster to prevent swinging of cam and rocker arm in the opposite direction during assembly.

2 Claims, 4 Drawing Sheets

ROCKER ARM CLEARANCE REMOVING DEVICE

BACKGROUND OF THE INVENTION

The present invention relates to a device for removing clearance or tappet clearance in a valve mechanism used for an internal combustion engine, particularly a horizontal opposed type internal combustion engine.

A tappet clearance removing device has heretofore been known, for example, in Japanese patent Laid-Open Nos. 41613/84 and 2266217/84 wherein a cutout portion is formed in an eccentric cam which supports a rocker arm, and a plunger of a hydraulic adjuster is brought into pressure contact with this cutout portion to exert a rotating force to the eccentric cam, thereby bringing the rocker arm into pressure contact with a valve operating cam and an intake or exhaust valve stem.

In the above prior art, since the pressure bearing surface of the cutout portion of the eccentric cam is so small in size and working radius that upon pressure contact therewith of the plunger of the hydraulic adjuster to apply a required torque thereto, a high surface pressure is developed, which is likely to cause friction. Further, in order for the plunger to act in a tangential direction, it has been necessary to pay special attention to the shape of the cutout portion and the mounting posture of the hydraulic adjuster.

The present invention has overcome the above-mentioned problems. More particularly, in a rocker arm clearance removing device wherein torque is applied by a hydraulic adjuster to an eccentric cam which supports a rocker arm and the resulting rotation of the eccentric cam causes the rocker arm to come into pressure contact with a valve operating cam and an intake valve or an exhaust valve, a first aspect of the present invention is characterized in that the eccentric cam is supported by a rocker arm shaft extending through an eccentric position of the cam; a substantially radially extending, pressure bearing arm is projected from an end portion of the eccentric cam so as to form a pressure bearing surface which faces in a rotating direction of the arm; and the hydraulic adjuster, which has a pressurizing surface for abutment with the pressure bearing surface, is disposed nearly perpendicularly to the pressure bearing surface.

The pressure bearing arm of the eccentric cam is pushed by the plunger of the hydraulic adjuster and thereby pivots about the rocker arm shaft to move the rocker amr. At this time, a large torque is developed even at a small urging force of the plunger because the working radius of the pressure bearing surface of the pressure bearing arm is larger than the radius of the eccentric cam. Additionally, since the hydraulic adjuster operates approximately perpendicularly to the pressure bearing surface, there will not be developed a sideways component of force, thus preventing wear of the hydraulic adjuster.

A second aspect of the present invention resides in a stopper mechanism which restricts the posture of the eccentric cam. More particularly, in a rocker arm device in an internal combustion engine wherein torque is applied by a hydraulic adjuster to an eccentric cam which supports a rocker arm and the resulting rotation of the eccentric cam causes the rocker arm to come into pressure contact with a valve operating cam and an intake valve or an exhaust valve, the second aspect of the present invention is characterized in that radially extending pressure bearing arm and engaging piece are projectingly provided on an end portion of the eccentric cam in a circumferentially spaced manner; an arm stopper is provided on an opening side of a case of the hydraulic adjuster to prevent the pressure bearing arm from entering the interior of the said case; and a swivel stop means adapted to engage the said engaging piece in a rotational position beyond a preset operational range of the eccentric cam to stop the cam is provided at a side part of the case.

Under the above construction, even when the pressure bearing arm turns to the hydraulic adjuster side, it will be stopped by the arm stopper so it will not strike the inner or end surface of the case. The rotation of the eccentric cam in the opposite direction is restricted by abutment of the engaging piece of the cam with the swivel stop provided on the case side.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENT

Figure 2:
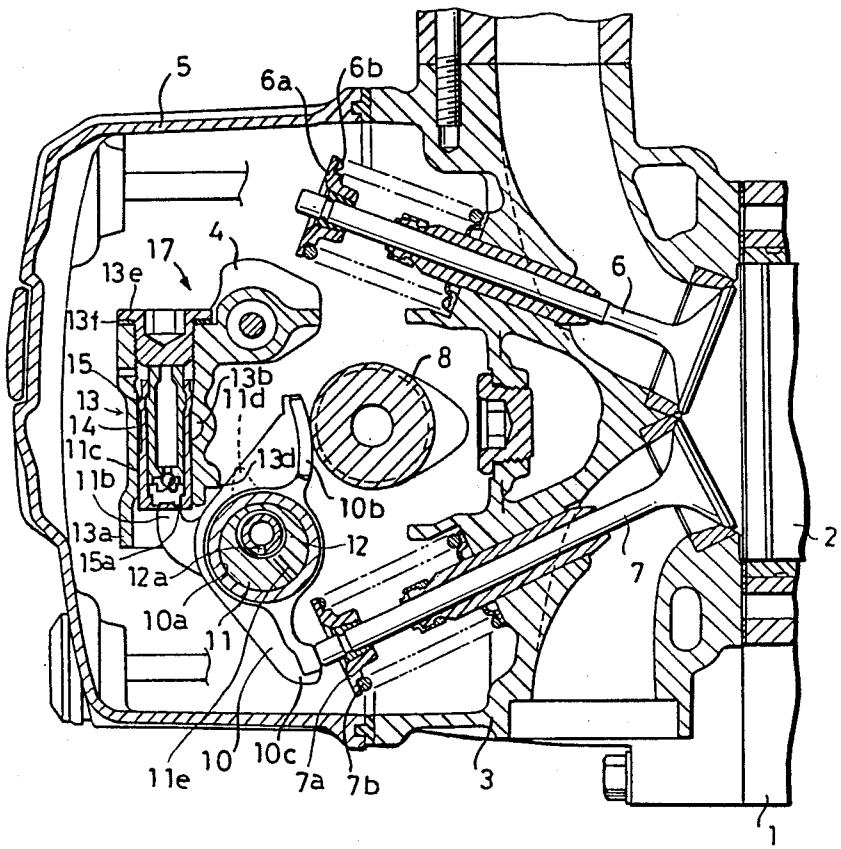
FIG. 2 is a longitudinal section view showing a rocker arm device on an exhaust valve side.

An embodiment of the present invention will now be described with reference to the drawings. A cylinder block 1 is provided having a horizontal bore. Pistons 2 are provided in the block 1. A cylinder head 3 is mounted on the block 1 and is provided with a cam holder 4 and a cover 5. An intake valve 6 and an exhaust valve 7 are mounted in the cylinder head 3 and urged up to respective closed positions by means of retainers 6*a*, 7*a* and springs 6*b*, 7*b*. A cam shaft 8 is held rotatably by the cylinder head 3 and cam holder 4.

Figure 1:
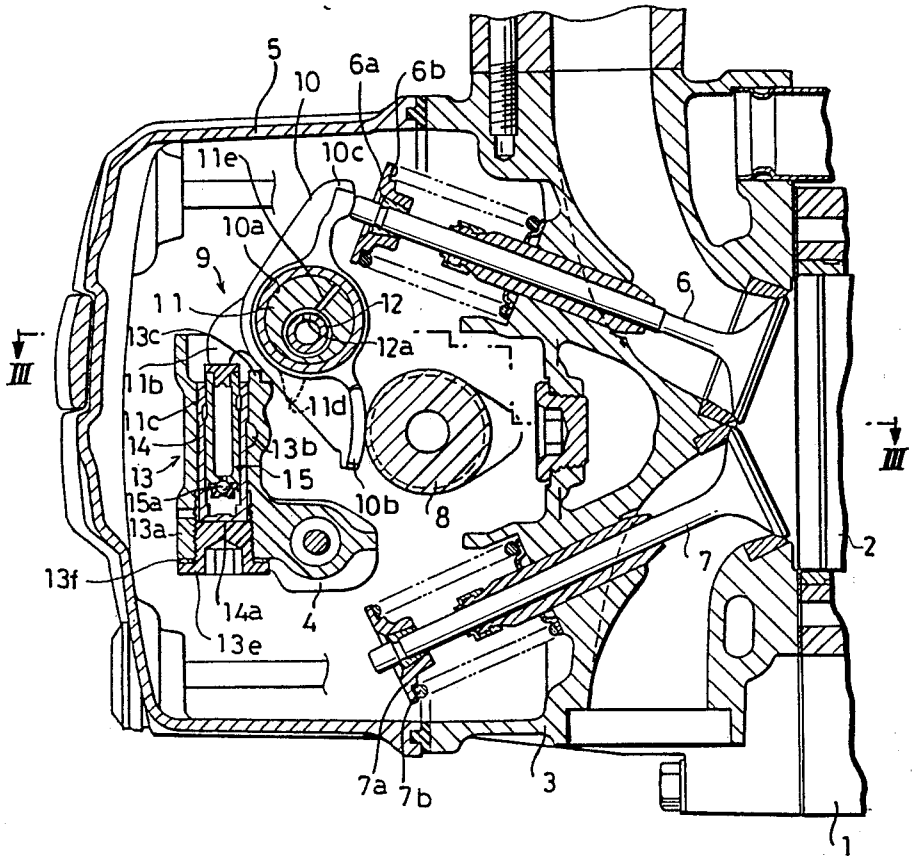
FIG. 1 is a longitudinal sectional view showing a rocker arm device on an intake valve side.
Figure 3:
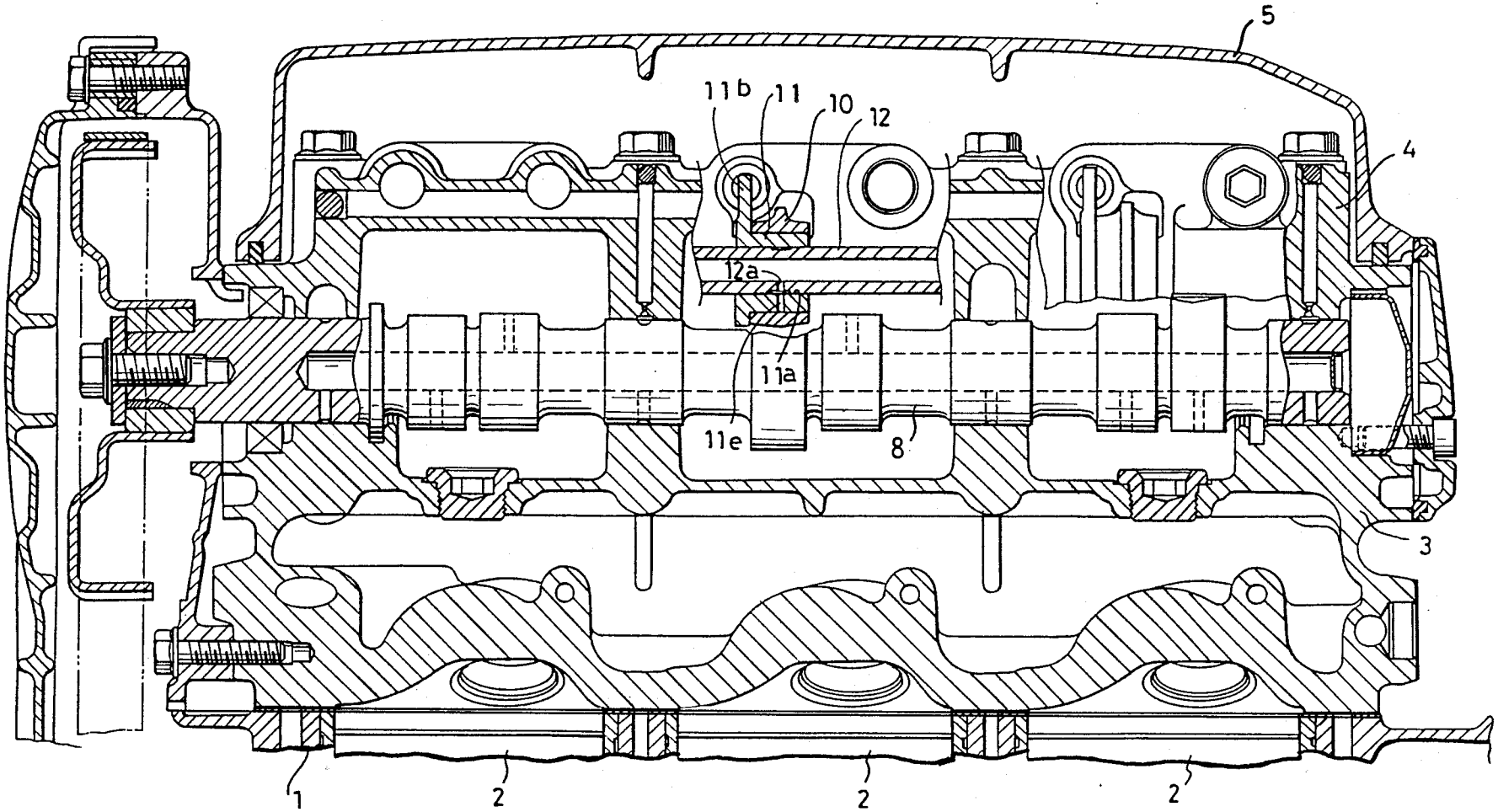
FIG. 3 is a sectional view taken on line III—III of FIG. 1.

FIG. 1 illustrates a rocker arm device 9 for the intake valve 6. A rocker arm 10 is provided centrally with a cam hole 10*a* and at both ends thereof with a cam-engaging portion 10*b* and a valve-engaging portion 10*c*. An eccentric cam 11 is fitted in the cam hole 10*a* and is supported by a rocker arm shaft 12 extending through an eccentric position.

Figure 4:
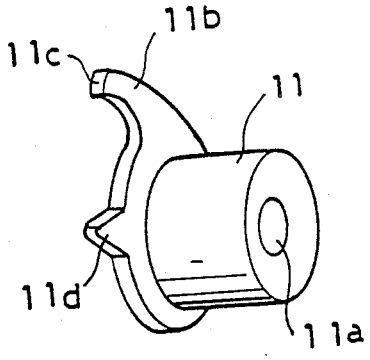
FIG. 4 is a perspective view of an eccentric cam.

As shown in FIG. 4, the eccentric cam 11 has an axial bore 11*a* formed in the eccentric position for insertion therein of the rocker arm shaft 12. Further, a pressure bearing arm 11*b* extends from one side end of the cam 11, with a pressure bearing surface 11*c* being formed at a distal end of the arm 11*b*. The pressure bearing arm 11*b* curves in a rotating direction of the arm. The pressure bearing surface 11*c* extends substantially tangentially to the eccentric cam 11 and faces in a direction opposite to the rotating direction of the arm. An engaging piece 11*d* is projectingly provided in a circumferentially spaced relation to the arm 11*b*. The rocker arm shaft 12 is attached to the cam holder 4.

To lubricate the fitting portions of the components described above, oil passages 12*a* and 11*e* are formed in communication with a central bore of the rocker arm shaft 12 and pressure oil is supplied from the central bore.

A holder portion 13*a* of a hydraulic adjuster 13 is provided integrally with the cam holder 4 and cylinder head 3, with a cylinder 14 and a hollow hydraulic plunger 15 being inserted into the holder portion 13*a*. A check valve 15*a* and pressure oil supplied from a pressure oil passage 13*b* passes through oil holes formed in the side faces of the cylinder 14*a* formed behind the plunger 15. From the upper end of the holder portion 13*a* there projects and arm stopper 13*c* and a swivel stop 13*d* upwards and sideways, respectively, while a plug 13*e* is threadedly fitted in the lower end of the holder portion through a shim 13*f*.

For the exhaust valve 7 there is provided a rocker arm device 17 as shown in FIG. 2. Also in this device 17 there are used components which are the same in structure as in the foregoing device 9 for the intake valve 6. The device 17 is mounted displaced in axial phase and reversely in vertical direction when compared to the device 9. However, the cylinder 14 and the piston 15 of the hydraulic adjuster face in the same direction as in the device 9. The bottom of the cylinder 14 serves as a pressurizing surface which is in contact with a pressure bearing surface 11*c*.

Figure 6:
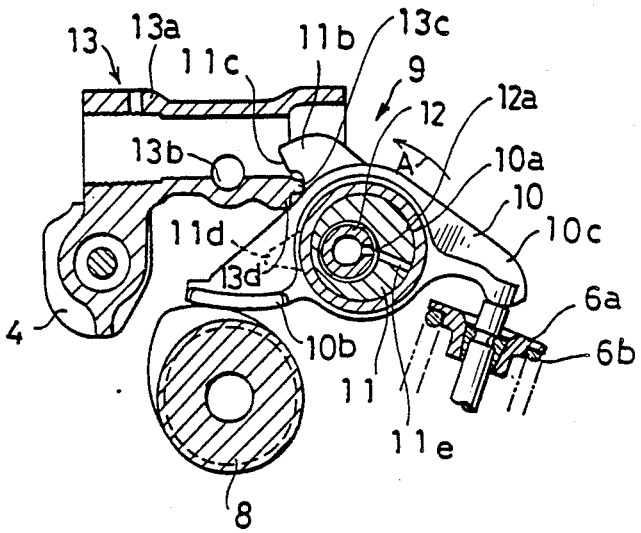
FIG. 5 and 6 are each a longitudinal sectional view in an assembling step.
Figure 5:
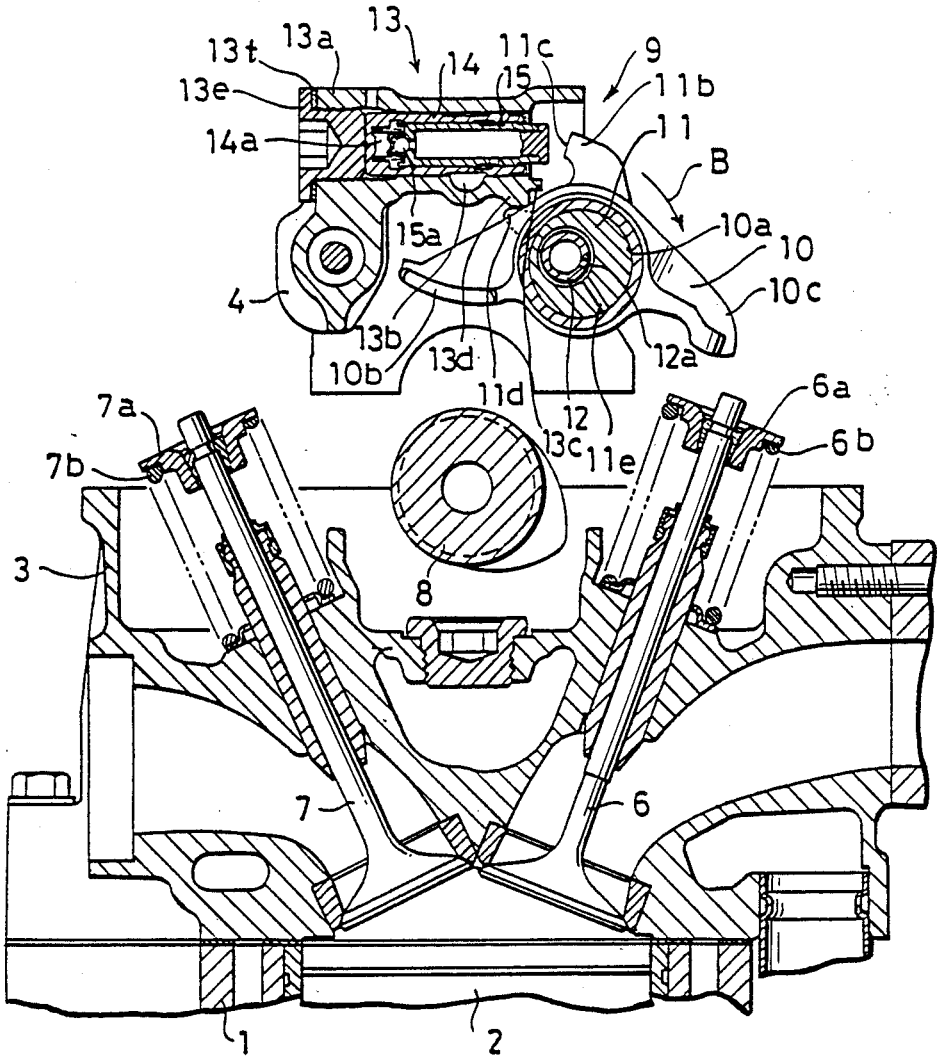

Both rocker arm devices 9 and 17 are mounted to the cam holder 4 in the posture as shown at the upper portion of FIG. 5. During assembly, as shown in FIG. 6, even when the pressure bearing arm 11*b* is about to fall in the direction of arrow A into the holder portion 13*a* due to its interference with another component, it will strike the arm stopper 13*c* and its turning motion will be prevented. Thus, there is no fear of damage to the inner or end surface of the holder portion 13*a*.

Further, the engaging piece 11*d* comes into abutment with the swivel stop 13*d* to stop the turning motion in the direction of arrow B at a point slightly beyond the maximum operational range of the eccentric cam 11, so that the center of the rocker arm 10 is positioned in a certain range. Therefore, as shown in FIG. 5, when the cylinder head 3 is turned 90° to cause the intake and exhaust valves 6 and 7 face upward and the cam holder 4 is mounted form above,the operated portion 10*b* and operating portion 10*c* of the rocker arm 10 can be positioned respectively above the cam shaft 8 and above the stem end of the intake valve 6. Thus, the assembly can be effected without any inconvenience.

The hydraulic adjuster 13 is mounted perpendicularly to the ground, and in both the rocker arm devices 9 and 17, the fitting portion of the cylinder 15 and the piston 14 faces upward, so during engine stall there is little likelihood of oil leakage from the interior and air is difficult to be incorporated therein. The plunger 15 or the cylinder 14 is pushed out hydraulically to pressurize the pressure bearing arm 11*b* to thereby rotate the eccentric cam 11, so that the rocker arm 10 is brought into pressure contact with the intake valve 6 or the exhaust valve 7 and the cam shaft 8 to remove tappet clearance. The rocker arm 10 pivots, centered on the eccentric cam 11, while retaining this state, to open or close the valve.

In the present invention, as set forth hereinabove, since the pressure bearing arm 11*b* projects outwardly and is pressurized, the lever ration can be large and sufficient torque can be applied to the eccentric cam even when the force exerted from the hydraulic adjuster 13 is small. This effect is enhanced by the particular shape of the arm and the positioning of the pressure bearing surface. Consequently, the pressure surface 11*c* and the pressure contact surface of the plunger 15 will not be as subject to wear. Additionally the pressurizing force acting on the eccentric cam 11 will not become deficient even when air is incorporated in the oil. Moreover, even when an assist spring for the application pf pressure is not used, the tappet clearance will be removed to eliminate the possibility of noise being generated.

Further, since the pressure bearing arm 11*b* projects outwardly, the hydraulic adjuster 13 can be easily mounted away from the rocker arm shaft 12 and eccentric cam 11 and in substantial alignment of its moving direction with a central line of the plunger 15, thus making it possible to prevent lateral pressure from acting on the plunger and cylinder. Additionally, the intake and exhaust side rocker arm devices 9 and 17 can be disposed in about the same positions, so with a single oil supply passage it is possible to supply pressure oil to the pressure oil passages 13*b* of both devices.

Additionally, since plural eccentric cams 11 are supported by a separate rocker arm shaft 12, pressure oil can be supplied through the rocker arm shaft to each eccentric cam 11, thus ensuring sufficient lubrication.

In the second aspect of the present invention, as set forth hereinabove, since there are provided swivel stop means such as the arm stopper 13*c* for restricting the rotation of the eccentric cam 11 as well as the engaging piece 11 and the swivel stop 13*d*, a central positioning of the rocker arm 10 can be ensured within a certain range at the time of assembly, thus facilitating the assembling.

Further, since the pressure bearing arm 11*b* can be prevent from entering the holder portion 13*a* of the hydraulic adjuster 13 by means of the arm stopper 13*c*, it is possible to prevent the pressure bearing arm 11*b* or the pressure bearing surface 11*c* from striking and damaging the holder portion at the time of assembly, thereby preventing later leakage of oil.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. In a rocker arm clearance removing device wherein torque is applied by a hydraulic adjuster to an eccentric cam which supports a rocker arm and the resulting rotation of the eccentric cam causes the rocker arm to come into pressure contact with a valve operating cam and intake valve or an exhaust valve, the improvement wherein the eccentric cam is supported by a rocker arm shaft extending through an eccentric position of the cam; an outwardly extending, pressure bearing arm is provided curving in the rotating direction of said arm and having a pressure bearing surface extending substantially tangentially to said eccentric cam and facing in a direction opposite to said rotating direction, said pressure bearing arm projecting from an end portion of the eccentric cam; and the hydraulic adjuster, which has a pressurizing surface for abutment with said pressure bearing surface, is disposed nearly perpendicularly to said pressure bearing surface, and wherein a radially extending engaging piece is projectingly provided on said end portion of the eccentric cam circumferentially spaced from said pressure bearing arm; an arm stopper is provided on an opening side of a case of the hydraulic adjuster to prevent the pressure bearing arm from entering the interior of said case; and a swivel stop means adapted to engage said engaging piece in a rotational position beyond a preset operational range of the eccentric cam to stop the cam is provided at a side part of said case.

2. In a rocker arm clearance removing device in a horizontally extending cylinder block having a cylinder head with a cam holder and a cover and a horizontally disposed camshaft supported by said cam holder to be perpendicular to an axis of a cylinder of said cylinder block, and a hydraulic adjuster disposed substantially perpendicular to the axis of the cylinder, wherein torque is applied by the hydraulic adjuster to an eccentric cam which supports a rocker arm and the resulting rotation of the eccentric cam causes the rocker arm to come into pressure contact with a valve operating cam and an intake valve or an exhaust valve, the improvement wherein the eccentric cam is supported by a rocker arm shaft extending through an eccentric position of the cam; an outwardly extending, pressure bearing arm is provided curving in the rotating direction of said arm and having a pressure bearing surface extending substantially tangentially to said eccentric cam and facing in a direction opposite to said rotating direction, said pressure bearing arm projecting from an end portion of the eccentric cam; and the hydraulic adjuster, which has a pressurizing surface for abutment with said pressure bearing surface, is disposed nearly perpendicularly to said pressure bearing surface.

* * * * *